US006573835B2

(12) United States Patent
Irizarry et al.

(10) Patent No.: US 6,573,835 B2
(45) Date of Patent: Jun. 3, 2003

(54) CHILD MONITORING DEVICE

(76) Inventors: Hector Irizarry, 600 Madison St., Hoboken, NJ (US) 07030; Philip M. Anderson, 37 Winding Way, Madison, NJ (US) 07940

( * ) Notice: Subject to any disclaimer, the term of this patent is extended or adjusted under 35 U.S.C. 154(b) by 0 days.

(21) Appl. No.: 09/950,496

(22) Filed: Sep. 13, 2001

(65) Prior Publication Data

US 2002/0005783 A1 Jan. 17, 2002

Related U.S. Application Data

(60) Continuation-in-part of application No. 09/728,967, filed on Dec. 4, 2000, now abandoned, which is a division of application No. 09/439,689, filed on Nov. 15, 1999, now Pat. No. 6,195,009.

(51) Int. Cl.[7] ..... G08B 23/00

(52) U.S. Cl. ..... 340/573.4; 340/572.1; 340/572.2; 340/572.5; 340/505; 340/573.1

(58) Field of Search ..... 340/573.4, 572.8, 340/572.7, 572.1, 572.2, 572.5, 505, 573.1, 10.1, 10.4

(56) References Cited

U.S. PATENT DOCUMENTS 3,911,534 A * 10/1975 Martens et al. ..... 340/572.7
4,510,490 A * 4/1985 Anderson, III et al. ..... 340/551
5,355,120 A * 10/1994 Ferguson et al. ..... 340/551
6,243,013 B1 * 6/2001 Dunn et al. ..... 340/572.7

* cited by examiner

*Primary Examiner*—Donnie L. Crosland
(74) *Attorney, Agent, or Firm*—Ernest D. Buff & Associates; Ernest D. Buff; Gordon E. Fish

(57) ABSTRACT

An apparatus monitors the departure of a child from an exit. The apparatus comprises: a magnetomechanically actuated electronic article surveillance system having an alarm; and a tag worn by the child. A field generating means of the system is adapted to generate an electromagnetic field at the exit. The tag is operative in the presence of the electromagnetic field to transmit a signal, which upon being detected, triggers the alarm. When the child passes through the electromagnetic field and departs from the exit, the tag transmits a signal that activates the alarm, thereby providing information to relatives of the child and store personnel concerning the child's whereabouts.

3 Claims, 3 Drawing Sheets

CHILD MONITORING DEVICE

CROSS-REFERENCE TO RELATED APPLICATIONS

This is a Continuation-In-Part of application Ser. No. 09/728,967, filed Dec. 4, 2000, abandoned, which, in turn, is a Division of application Ser. No. 09/439,689, filed Nov. 15, 1999, now U.S. Pat. No. 6,195,009.

BACKGROUND OF THE INVENTION

1. Field of the Invention

The present invention relates to a system and method for monitoring the departure of a child from a retail store or other area having a magnetomechanical electronic article surveillance system.

2. Description of the Prior Art

A lost or abducted child is a parent's greatest fear. While shopping with a small child, a parent or guardian remains constantly on watch to make sure that the child does not wonder off. From the store's perspective, this constant concern presents a major distraction, leading to loss of sales. Many retail stores have installed a children's play area to minimize the shopping parent's distraction. These play areas do not effectively prevent a child from wandering unless the play area is supervised.

Alternative measures directed to solving the wandering child dilemma have been the subject of much investigation. Numerous devices have been disclosed over the years to tackle this problem. U.S. Pat. No. 5,848,567 to Colaianni discloses a leash adapted to attach a child to the guardian. U.S. Pat. No. 5,510,771 to Marshall employs a cable that alarms if it is broken. These devices put sever limitations on the mobility of child and guardian. U.S. Pat. No. 4,694,284 to Leveille et al. transmits an alarm signal when a collar is removed from a child. U.S. Pat. No. 5,617,074 to White discloses a button having a transmitter and adapted to be attached to a child's clothing or wrist strap. The button actuates an alarm if it is tampered with. Such devices may help deter abduction, but provide a less than satisfactory solution to the problem presented by a wondering child.

Generally, electronic devices designed either to monitor children within an enclosed area, or within the framework of an individual system. In the first case, the system alarms when the child leaves the monitored area. In the second case, the child wears a tag and the guardian carries a control unit. When the child strays too far from the unit, the distance between the two causes the sounding of an alarm carried by either or both of the control unit and the tag.

U.S. Pat. No. 5,337,041 to Friedman employs a tag worn by a child and adapted to be triggered by the guardian to sound an alarm when the child is out of sight. U.S. Pat. No. 5,307,763 to Arthur et al. places a loop antenna around the border of an area appointed for confinement of a child and tag alarms adapted to be worn by a child when appointed for transport outside the protected area. This device is expensive, requiring purchase of a monitoring system and wiring of an entire monitored area. U.S. Pat. No. 5,640,147 to Chek et al. discloses a tag adapted to be worn by a child. The tag is provided with a microphone and transmitter, which enables a parent to listen in and thereby monitor the child's activity. These devices may help deter abduction, but they fail to solve the problem presented by the wondering child.

Numerous devices are adapted to trigger an alarm when a battery-powered tag worn by the child exceeds a predetermined distance from a transmitter carried by the guardian. Representative of these devices are those disclosed by: DE Patent 19,608,348 to Whitehurst; U.S. Pat. No. 5,661,460 to Budzyna et al.; WO Patent 9,618,913 to Budzyna et al.; WO Patent 9,627,173 to Campana; WO Patent 9,614,625 to Edwards; U.S. Pat. No. 5,512,879 to Stokes; WO Patent 9,607,998 to Gerstenberger et al.; GB Patent 2,279,170 to Newton; U.S. Pat. No. 5,289,163 to Perez et al.; GB Patent 2,248,331; U.S. Pat. No. 4,899,135 to Gharariiran; U.S. Pat. No. 5,557,259 to Musa; U.S. Pat. No. 5,461,365 to Baringer et al. FR 2704345 to Gadi; GB Patent 2,276,025 to Bartwell; FR Patent 2,674,351 to Dal Bo et al; FR Patent 2,608,868 to Estienne; WO Patent 8,706,748 to Corwin et al.; GB2182183 to Garrett et al.; U.S. Pat. No. 4,598,272 to Cox; FR Patent 2,543,715 to Mayer; DE Patent 3,215,942 to Fuchshuber; GB Patent 1,496,945; U.S. Pat. No. 5,6890240 to Traxler; and U.S. Pat. No. 5,812,056 to Law. Retail stores oftentimes generate large amounts of electronic noise. Such noise typically emanates from point of sale equipment and electronic article surveillance systems. These devices frequently exhibit extreme performance variability with differing electronic noise environments. U.S. Pat. No. 5,629,678 to Gargano et al. employs a tag that is implanted in the child; and which has obvious shortcomings. In each of these devices there is imposed an additional restriction that impedes the performance thereof. The additional restriction requires that the store install special monitoring equipment or that the guardian carry a monitoring unit.

Additional variations of a child monitoring system have been disclosed. British Patent 2,291,303 to Duffy provides direction to a transmitter worn by the child. In U.S. Pat. No. 4,785,291, the tone changes with distance changes. U.S. Pat. No. 5,119,072 to Hemingway discloses a weak signal alarm with a microphone. U.S. Pat. No. 5,021,794 to Lawrence uses transmitter/receiver and works through the cellular phone system. GB Patent 2,218,245 to Hoyle et al. discloses a device that protects babies from unauthorized removal from a hospital. GB Patent 2,248,330 to Seeman uses infrared or sonic signals. WO Patent 8,703,404 to Royoux has LEDS indicating direction and distance. In each of these devices there is imposed the further requirement that the store install special monitoring equipment or the guardian carry a monitoring unit.

EP Patent 323,041 to Newman et al. uses a magnetic strip in a wrist or ankle strap to protect against unauthorized removal of an infant. This is one of the technologies used in electronic article surveillance (EAS) systems. Numerous EAS patents exist that employ detecting the harmonics generated by a magnetic strip in an interrogation zone. Representative of these EAS patents is U.S. Pat. No. 4,553,136 to Anderson, et al. Unfortunately, devices utilizing harmonic EAS technology have a very short detection range, typically three feet, and suffer from a low detection rate. Such systems are also susceptible to false alarms.

When EAS systems are used, markers are attached to articles to be protected. The markers are responsive to an electromagnetic field generated at the store's exit by the EAS system's transmitter. Each marker must be removed or deactivated before an article to which it is affixed leaves the store. Otherwise, upon exiting the store, the marker disturbs the field. This disturbance is detected by the EAS system, and an alarm is triggered. U.S. Pat. No. 4,510,489 discloses a magnetomechanical technology used in EAS systems that have been employed to protect infants from unauthorized removal from hospitals. EAS markers are generally inexpensive and operate as a passive device, without their own power. As a result, the operating range of EAS markers is limited and their detection rate, though acceptable for anti-theft applications, is much too low to assure protection of children, especially if a store or other building has a wide exit.

U.S. Pat. No. 5,604,485 to Lauro et al. discloses an RF tag comprised of a plurality of RF resonant circuits, which are disposed in a three-dimensional array. Resonant RF printed circuits are easily detuned when placed in close proximity with a body, and are therefore not particularly well suited for monitoring children. Since the tag is essentially a square, it is not easily adapted to monitoring children; the combined size and shape of the tag prevent it from being unobtrusively attached to a child's clothing. Placing two tags at right angles to increase coupling with the detection antenna yields a tag that is much too large in all three dimensions.

Implementation of a child monitoring system within a retail environment in the conventional way would require the store to purchase and maintain a system. If the retail facility already possessed an EAS system, it would have to maintain both systems. This is a costly solution. Alternatively, with conventional child monitoring systems, protection of each child would require the responsible parent to provide his own individual system. The shear number of teachings directed to child monitoring systems and the conspicuous absence from the marketplace of such systems strongly suggests that the problem remains to be solved.

Accordingly, there remains a need in the art for a cost-effective system that exhibits an extremely high detection rate and which accurately and reliably monitors and protects against the unauthorized departure of children from retail stores.

SUMMARY OF THE INVENTION

The present invention provides a system and method for monitoring the departure of a child from a retail store or other area wherein an magnetomechanical electronic article surveillance system has previously been installed.

A large number of retail stores currently have magnetomechanical electronic article surveillance systems, and more stores are employing them every year. The present invention is especially suited for and leverages the use of these magnetomechanical electronic article surveillance systems by adding child monitoring functionality.

Generally stated, the present invention provides an apparatus, tag, and method for monitoring the departure of a child from an exit, comprising: a magnetomechanical electronic article surveillance system for generating an electromagnetic field at the exit, and a tag being operative to mechanically resonate in response to application of the electromagnetic field; whereby an alarm means carried by the tag triggers an alarm carried by the magnetomechanical article surveillance system upon departure of the child from the exit.

More specifically, the present invention provides a tag for monitoring the departure of a child from an exit associated with a magnetomechanical electronic article surveillance system. The tag comprises a first magnetomechanical marker having a first elongated axis and a second magnetomechanical marker having a second elongated axis. The first elongated axis of the first magnetomechanical marker is fixed substantially perpendicular to the second elongated axis of the second magnetomechanical marker. This arrangement of magnetomechanical markers provides an essentially planar tag that has significantly enhanced detectability over magnetomechanical anti-theft tags.

Further, the present invention provides an apparatus for monitoring the departure of a child from an exit that comprises a magnetomechanical electronic article surveillance system for generating an electromagnetic field at the exit, and a tag having the aforementioned composition, physical and geometric properties, and adapted to be worn by the child. The tag is operative in response to the electromagnetic field of the magnetomechanical electronic article surveillance system to cause the magnetomechanical electronic article surveillance system to alarm when the child attempts to depart through the exit.

Still further, the present invention provides a method for monitoring a child departing from an exit, comprising the steps of placing a magnetomechanical electronic article system at the exit; and placing a tag, having the above-described structure and properties, on the child. In practice of this child monitoring method, the tag causes the magnetomechanical electronic article surveillance system to alarm on departure of the child from the exit.

Advantageously, the present invention leverages a store's preexisting magnetomechanical EAS system by adding thereto a child monitoring functionality. Stores without magnetomechanical electronic article surveillance systems can also obtain the benefits of the theft protection and child monitoring functions by employing this invention. In addition, the method and apparatus of the invention are much more cost effective, efficient, and reliable than devices wherein the child monitoring function is approached in the conventional way.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF THE PREFERRED EMBODIMENTS

Figure 1:
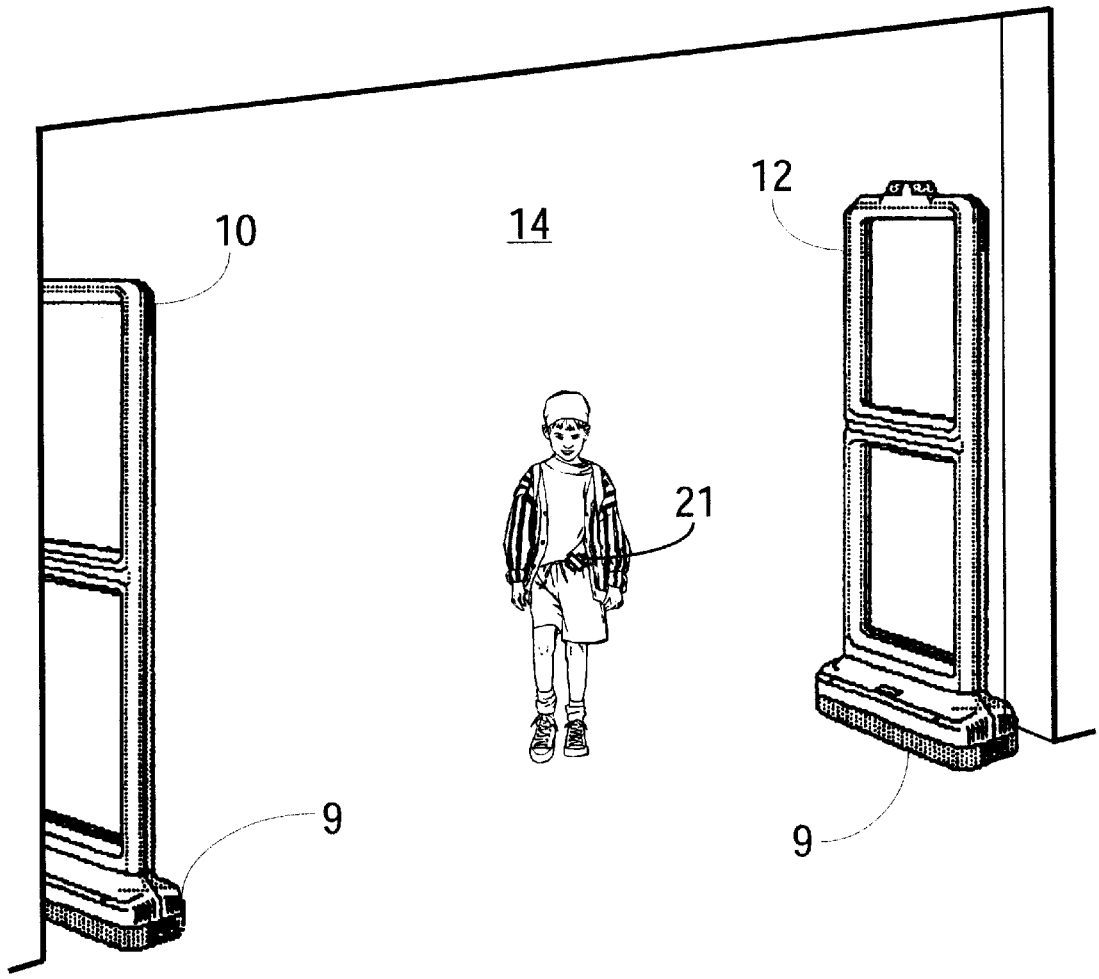
FIG. 1 is a perspective view of a child to which there is attached a tag of the invention, the child being shown to be entering a magnetomechanical electronic article surveillance system.

A significant number of retail stores presently utilize anti-theft systems known as electronic article surveillance systems (EAS). More stores and store chains are employing them every year. The present invention leverages the extant use of EAS systems by adding thereto child-monitoring functionality.

Many retail stores employ EAS systems to protect against theft. Conventional EAS systems comprise a transmitter for generating an electromagnetic field at the exit of a retail establishment, a marker attached to an article to be protected from theft, and a receiver. The marker is responsive to the electromagnetic field. It is designed to be removed or deactivated before the article leaves the store. Otherwise, upon exit of the article, the marker disturbs the field. The disturbance is detected by the receiver and the EAS system's alarm is triggered.

While there are numerous EAS technologies, the industry is essentially dominated by three technologies:

magnetomechanical, RF, and magnetic. Magnetomechanical systems use an alternating electromagnetic fields to detect the mechanical resonance of an elongated amorphous ferromagnetic tag. RF systems use alternating electromagnetic fields to detect the electrical resonance of a tag comprised of a printed circuit coil, while magnetic systems use alternating electromagnetic fields to look for harmonics generated by an elongated ferromagnetic tag.

The magnetomechanical electronic article surveillance systems are the most accurate and reliable of the three. For this reason magnetomechanical electronic surveillance systems, frequently referred to as systems based on acoustomagnetic technology, have enjoyed widespread use. These systems comprise a transmitting pedestal, a receiving pedestal, and tags or markers. The pedestals are placed across the exit to be protected. Disposable markers have an adhesive strip and are typically attached to hard goods, while permanent markers are attached to soft goods (clothing) by fasteners such as garment pins and the like. Disposable markers are deactivated upon purchase of a protected item, while the permanent marker is removed at point of purchase.

Magnetomechanical markers have a cavity for holding a resonator strip made of amorphous (non-crystalline) ferromagnetic metal (iron or cobalt based alloy). The strip must be free to vibrate in the cavity. An amorphous metal strip is unique in that it is very hard mechanically while being very soft magnetically. With this combination of properties, the strip is extremely durable, resisting degradation or alteration of its magnetic response while, at the same time being easy to magnetize and demagnetize. The strip has a very sharp mechanical resonance due to its mechanical hardness. The resonant frequency of the strip is predetermined, and typically near 60 kHz for an amorphous strip near 35 mm long. In addition, the amorphous strip is magnetostrictive. That is to say, its length changes during its residence in an applied magnetic field. For a signal to be generated by the strip, there must also be present thereon a DC bias magnetic field. A second piece of magnetic metal disposed in close proximity to the strip accomplishes that purpose. Upon being magnetized, the markers are active. To turn off the disposable marker, the bias metal is demagnetized. Normally, the bias piece in the permanent marker cannot easily be turned off. Thus, it continues to exert a DC bias magnetic field on the strip until demagnetized by special equipment appointed for that purpose.

The transmitting pedestal radiates pulsed (off and on) magnetic fields at the resonant frequency of the marker. When an active marker is placed in the alternating magnetic field, the resonator strip mechanically resonates via magnetostriction and modulates the field of the bias metal. This alternating magnetic field is then detected by the coils in the receiving pedestal and activates the alarm.

Referring to FIG. 1 of the drawings, there is shown an apparatus for monitoring the departure of a child from an exit. Magnetomechanical electronic article surveillance system 9 comprising transmitter 10 and receiver 12 is set across exit 14. Transmitter 10 generates an electromagnetic field at exit 14; and tag 21, worn by a child, is responsive to the electromagnetic field causing receiver 12 to alarm on departure of the child from exit 14.

Figure 2:
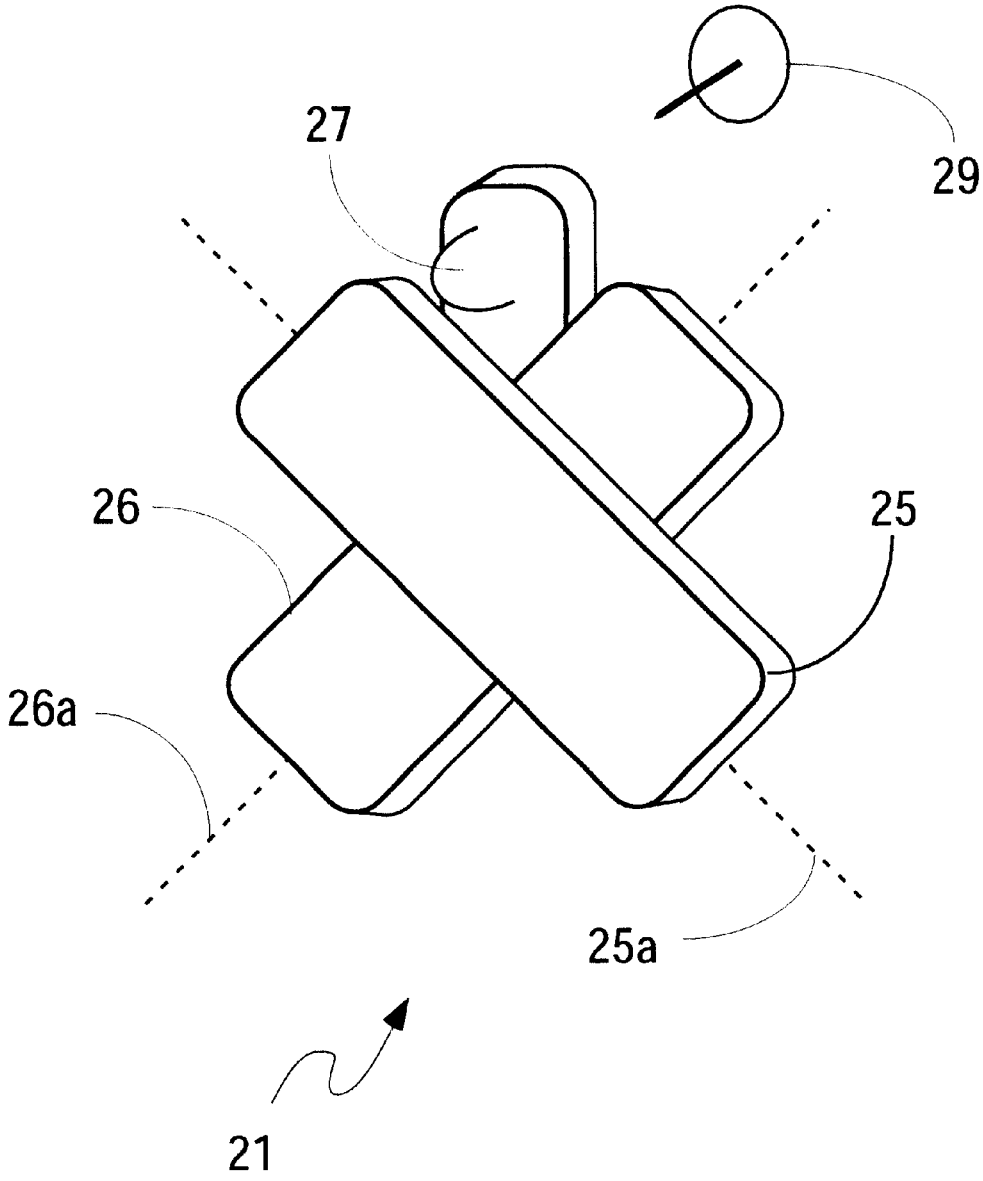
FIG. 2 is a perspective view of the tag shown in FIG. 1, and showing the elements of the tag, including two magnetomechanical markers, a locking mechanism, and garment pin.

FIG. 2 shows a tag 21 comprised of two magnetomechanical markers for use in a child monitoring system. Tag 21 comprises: first magnetomechanical marker 25 having first elongated axis 25*a;* and second magnetomechanical marker 26 having second elongated axis 26*a,* the first elongated axis 25*a* of first magnetomechanical marker 25 being fixed substantially perpendicular to the second elongated axis 26*a* of second magnetomechanical marker 26. Magnetomechanical EAS markers have preferred orientations, which maximize the signal emitted during residence in an interrogation zone generated by the magnetomechanical EAS system, thereby producing signal response that affords best detection. By adding a second marker at a different orientation, the detection rate of an ordinary magnetomechanical EAS marker is significantly enhanced. Markers 25 and 26 are preferably the permanent type, in which the magnetic coercivity of the bias field is high. These markers are oftentimes referred to in the EAS art as "hard" tags.

Figure 3:
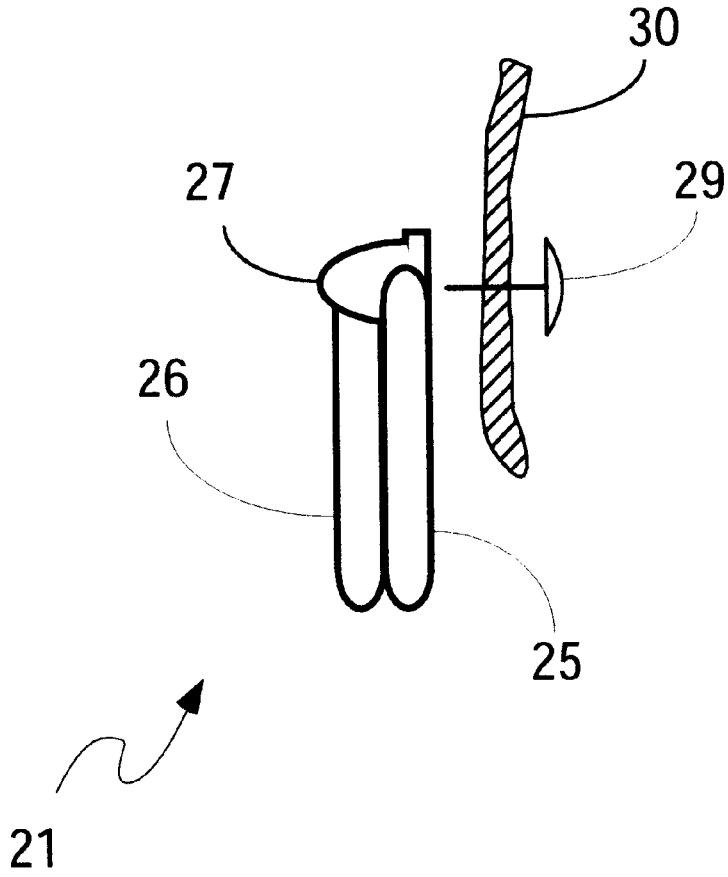
FIG. 3 is a side view of the tag shown in FIG. 2, depicting the manner of attaching the tag and pin to a portion of the garment.

Preferably, as shown in FIGS. 2 and 3, marker 21 is provided with locking means 27 for receiving pin 29. Locking means 27 and pin 29 are known in the art for attaching EAS markers to clothing or other soft goods. Marker 21 is secured to garment 30 by locking means 27 and pin 29.

The resulting tag is essentially planar in dimensions and yields substantially improved detection over single marker EAS tags.

A facility such as a retail store can monitor the egress of children from its exits by (i) placing a magnetomechanical electronic article surveillance system at an exit, and (ii) attaching a tag to a child to be protected, the tag comprising two magnetomechanical markers disposed substantially perpendicular to each other.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A tag for monitoring the departure of a child from an exit provided with a magnetomechanical electronic article surveillance system that radiates an alternating electromagnetic field at a frequency, comprising:

a. first magnetomechanical marker having a first elongated axis and a first preselected resonant frequency;

b. second magnetomechanical marker having a second elongated axis and a second preselected resonant frequency; and c. said first elongated axis of said first magnetomechanical marker being substantially perpendicular to said second elongated axis of said second magnetomechanical marker and said frequency of said electromagnetic field being at said first and second preselected resonant frequencies.

2. An apparatus for monitoring the departure of a child from an exit, comprising:

a. a magnetomechanical electronic article surveillance system having an alarm and a field generating means for generating an alternating electromagnetic field at a frequency at said exit;

b. a tag worn by said child, said tag being responsive to said electromagnetic field to generate a signal which, upon being detected by said article surveillance system, triggers said alarm;

c. said tag comprising a first magnetomechanical marker having a first elongated axis and a first preselected resonant frequency, and a second magnetomechanical marker having a second elongated axis and a second preselected resonant frequency, the first elongated axis of said first magnetomechanical marker being substantially perpendicular to the second elongated axis of said second magnetomechanical marker and said frequency of said electromagnetic field being at said first and second preselected resonant frequencies;

whereby said alarm is triggered by said tag on departure of said child from said exit.

3. A method for monitoring a child departing from an exit, comprising the steps of:

a. placing at said exit a magnetomechanical electronic article surveillance system having an alarm and a field generating means for generating an alternating electromagnetic field at a frequency;

b. placing a tag on said child, said tag comprising a first magnetomechanical marker having a first elongated axis and a first preselected resonant frequency and a second magnetomechanical marker having a second elongated axis and a second preselected resonant frequency, said first elongated axis of said first magnetomechanical marker being substantially perpendicular to said second elongated axis of said second magnetomechanical marker, and said frequency of said electromagnetic field being at said first and second preselected resonant frequencies, and said tag being responsive to said electromagnetic field to generate a signal which, upon being detected by said article surveillance system, triggers said alarm; and c. detecting the triggering of said alarm.

* * * * *